US006146213A

United States Patent [19]

Yoon

[11] Patent Number: 6,146,213

[45] Date of Patent: Nov. 14, 2000

[54] WIRE CONNECTION WITH EXCHANGEABLE SECURING MEMBER FOR ELECTRIC CONNECTION TERMINAL ASSEMBLY

[76] Inventor: Heung-Sik Yoon, 101 Dongkyo Villa, 153-6, Dongkyo-dong, Mapo-ku, Seoul, Rep. of Korea

[21] Appl. No.: 09/209,642

[22] Filed: Dec. 10, 1998

[51] Int. Cl.[7] ..... H01R 9/26; H01R 13/66

[52] U.S. Cl. ..... 439/716; 439/532

[58] Field of Search ..... 439/716, 527, 439/532, 715, 714, 713, 717, 92, 94

[56] References Cited

U.S. PATENT DOCUMENTS

| | | | |
|---|---|---|---|
| 5,388,999 | 2/1995 | Nozick | 439/94 |
| 5,803,772 | 9/1998 | Muller et al. | 439/716 |
| 5,876,252 | 2/1995 | Hahn et al. | 439/701 |

*Primary Examiner*—Lincoln Donovan
*Assistant Examiner*—Chandrika Prasad
*Attorney, Agent, or Firm*—Skjerven Morrill MacPherson LLP; Alan H. MacPherson

[57] ABSTRACT

A wire connecting device includes an electrically conductive connection base and two spring-loaded connection plates for holding wires against the connection base. The connecting device is configured to be mounted in two different ways. The device may be mounted directly to a mounting surface by using mounting brackets on either side of the device that fit protrusions and grooves on the device. Alternatively, the device may be mounted to an angle iron by using a securing member shaped to mate with both the device and the angle iron. An electrically conductive connecting member couples the device to one or more similar connecting devices or, alternatively, a connecting member provides structural support between the device and at least one other similar connecting device.

21 Claims, 8 Drawing Sheets

WIRE CONNECTION WITH EXCHANGEABLE SECURING MEMBER FOR ELECTRIC CONNECTION TERMINAL ASSEMBLY

BACKGROUND OF THE INVENTION

1. Field of the Invention

The present invention generally relates to a wire connecting device for an electric connection terminal assembly, and more particularly to a wire connecting device comprising a connecting body adapted to connect or disconnect a leading wire easily without any special tools.

2. Description of the Prior Art

Generally, an electric connection terminal assembly is used to distribute electrical signals or electrical energies from the outside or other different equipment to several points. Especially, the electrical connection terminal assembly allows the same amount of energy or the same signal to be transmitted as a strand of the wire is connected to a specific position.

In the past, there is used a wire connecting device that was attained by the steps of drilling several holes at regular intervals on one side of the baseplates connected one another, putting screws having the corresponding diameter into the holes, winding one peeled end of the leading wire around the screws, and tightening the screws.

With such a conventional wire connecting device, it is very troublesome and takes plenty of time to carry out the operation consisting of the steps of peeling one end of the leading wire, winding the peeled end of the wire around the fixing screw, and tightening the screws, as mentioned above.

Lately, there has been developed a wire connecting device adapted to carry out connection of the leading wire more easily, which is disclosed in Korean Utility Model application No. 54481/1996 filed previously in the name of the applicant.

According to the above mentioned wire connecting device, a connecting plate is mounted elastically for connecting leading wires, and a push button is provided for pressing the connecting plate. The method for connecting the leading wire comprises the steps of pulling apart the connecting wire plate by pressing the push button, inserting the peeled end of the connecting wire therebetween, and releasing the push button whereby the leading wire is connected to the connecting plate by virtue of the repulsive force of the spring.

However, such a wire connecting device has a drawback in that the connection terminal assembly is mounted on the control board by weld, thus limiting installation conditions.

On the contrary, in a case that the wire connecting device is to be mounted inside equipment using an angle iron in compliance with the equipment used, it is necessary to provide a structure including the wire connecting device and a securing member adapted to engage into the angle iron.

To this end, a separate wire connecting device is manufactured and used. Therefore, it is required to manufacture at least two types of the device, one being mounted directly on the control board by weld, and the other having the securing member for mounting on the angle iron. In the case of the wire connecting device mounted on the angle iron, it is essential to manufacture various kinds of the assembly including the wire connecting device and the securing member in compliance with the sizes and specifications of equipment from several manufacturers, resulting in higher manufacturing costs.

SUMMARY OF THE INVENTION

It is an object of the present invention to provide a wire connecting device for an electric connection terminal assembly eliminating the above mentioned drawbacks.

According to the present invention, this object is accomplished by providing a wire connecting device for an electric connection terminal assembly comprising at least one connecting body adapted to connect or disconnect a leading wire, and at least one exchangeable securing member connected to the bottom of the connecting body, said securing member being formed in various sizes and shapes to connect to the connecting body.

According to one aspect of the present invention, the connecting body has a T-shaped groove formed at its lower part, a T-shaped protrusion is provided on the top of the securing member attached to the connecting body, and on the lower part of the securing member is provided a structure adapted to be fixed to an angle iron.

According to another aspect of the present invention, the connecting body has a T-shaped groove formed at its lower part, a connecting groove at its upper part, a connecting bar inserted into the connecting groove, and a connecting bar arranged on the underside of the connecting strip.

BRIEF DESCRIPTION OF THE DRAWINGS

The details of the present invention will be described in connection with the accompanying drawings, in which.

DETAILED DESCRIPTION OF THE PREFERRED EMBODIMENTS

Now, the preferred embodiments of the present invention will be described below with reference to the accompanying drawings.

Figure 1:
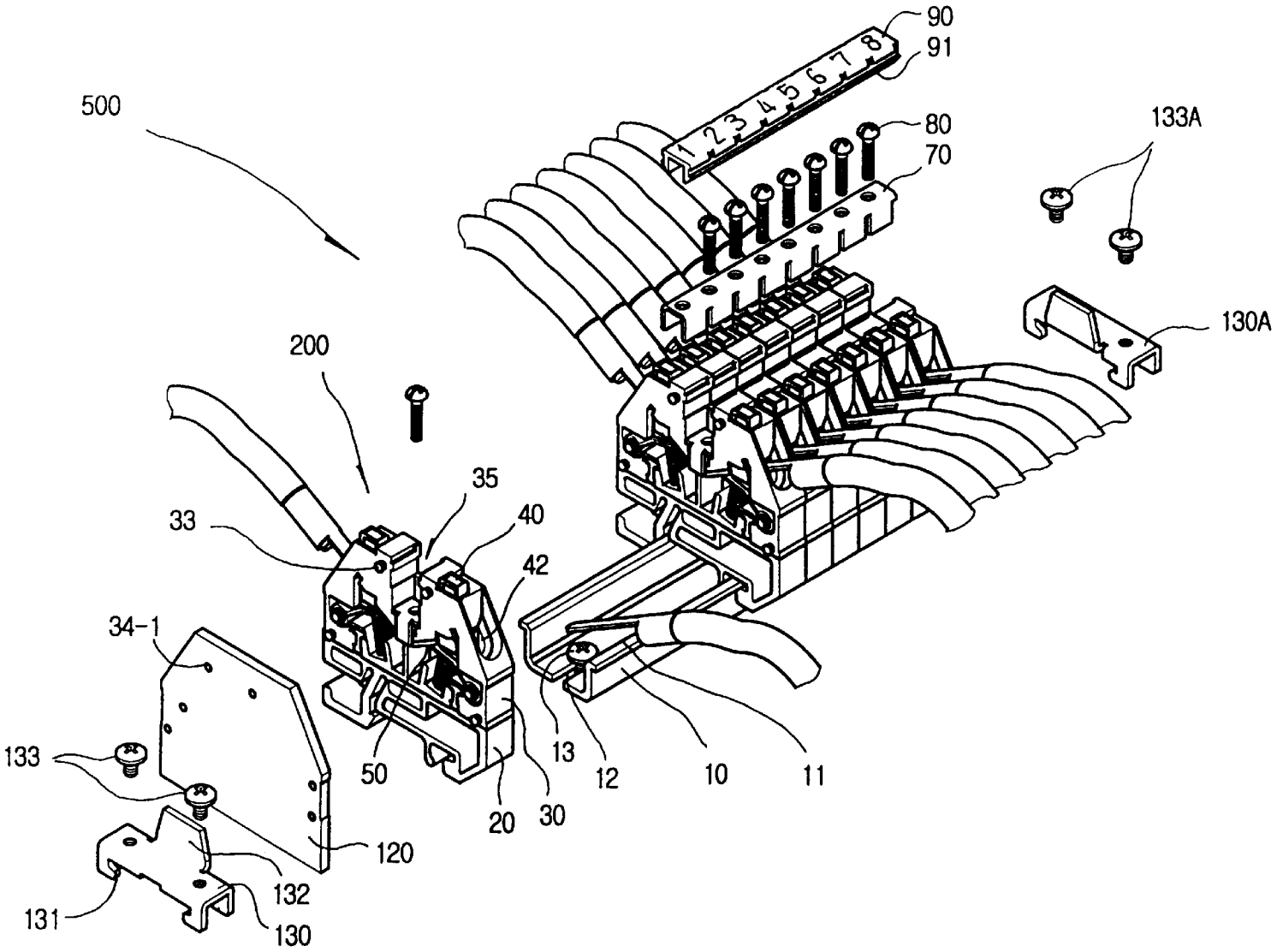
FIG. 1 is an exploded perspective view showing an embodiment of the wire connecting device with exchangeable securing member for electric connection terminal assembly according to the present invention.

FIG. 1 is an exploded perspective view showing an embodiment of the wire connecting device with exchangeable securing member for an electric connection terminal assembly according to the present invention, which is mounted on an angle iron 10. The angle iron 10 takes a U-shaped form. On each edge of the angle iron 10 is provided a protruded fixing rim 11, and at the each side of the angle iron 10 is formed a fixing hole 12, into which a fixing bolt 13 is inserted.

An electric connection terminal assembly 500 comprises a plurality of wire connecting devices 200 mounted on the angle iron 10. In each of the wire connecting devices 200 are provided a connecting plate 100, actuated by a push button 40, and a connection base 50. On each side of the wire connecting device 200 is formed a connecting hole 42, into which one peeled end of the leading wire 600 is inserted. The one peeled end of the leading wire 600 is connected to the connection base 50. The operation of the wire connecting device 200 is as follows. By the repulsive force of a spring 110 arranged in a spring groove 44 formed at the lower part of the connecting plate 100, the connecting plate 100 is forced to rise upwards. For the turning portion of the connecting plate 100, a hinge pin 43 is engaged into a hinge hole 101 of the connecting plate 100, and a connecting end 102 of the connecting plate 100 contacts with a connecting piece 51 of the connection base 50.

And a connecting member 70 is inserted into a connecting groove 70-1 formed continuously at the lower part of a cap groove 35 formed at the upper part of the wire connecting device 200, so that the connecting member 70 keeps in contact with the connection base 50.

A partition 38 formed at one side of the connecting groove 70-1 is inserted into a spacing groove 72 of the connection member 70. A connecting screw 80 is engaged into a nut 60 via a connecting hole 71 and a connecting hole 53 formed at a connecting portion 52.

The electric connection terminal assembly 500 constructed as mentioned above is mounted on the angle iron 10 by means of the securing member 20 attached to the bottom of the wire connecting device 200. Wire connecting devices 200 are coupled to each other by engagement of protrusions 33 formed on the front surface and grooves 34 formed on the rear surface of the wire connecting device 200.

A plurality of the wire connecting devices 200 coupled as mentioned above are mounted on the angle iron 10 by the securing members 20. On the top of each securing member 20 is provided a T-shaped protrusion 24, which is inserted into a T-shaped groove 31 formed at the lower part of the wire connecting device 200. To eliminate the possibility of detachment between the T-shaped protrusion 24 and the T-shaped groove 31, a locking groove 32 is formed at the entrance of the T-shaped groove 31, and a fixing portion 24-1 is provided on the inner side of the T-shaped protrusion 24.

At the lower part of the securing member 20 is formed an angle iron groove 21, which is engaged with the protruded fixing rim 11. On the opposite side of the angle iron groove 21 is provided a fixing projection 22 formed elastically at the release lever 23, by which the securing member 20 can be mounted on or detached from the angle iron 10 easily and conveniently.

Figure 5:
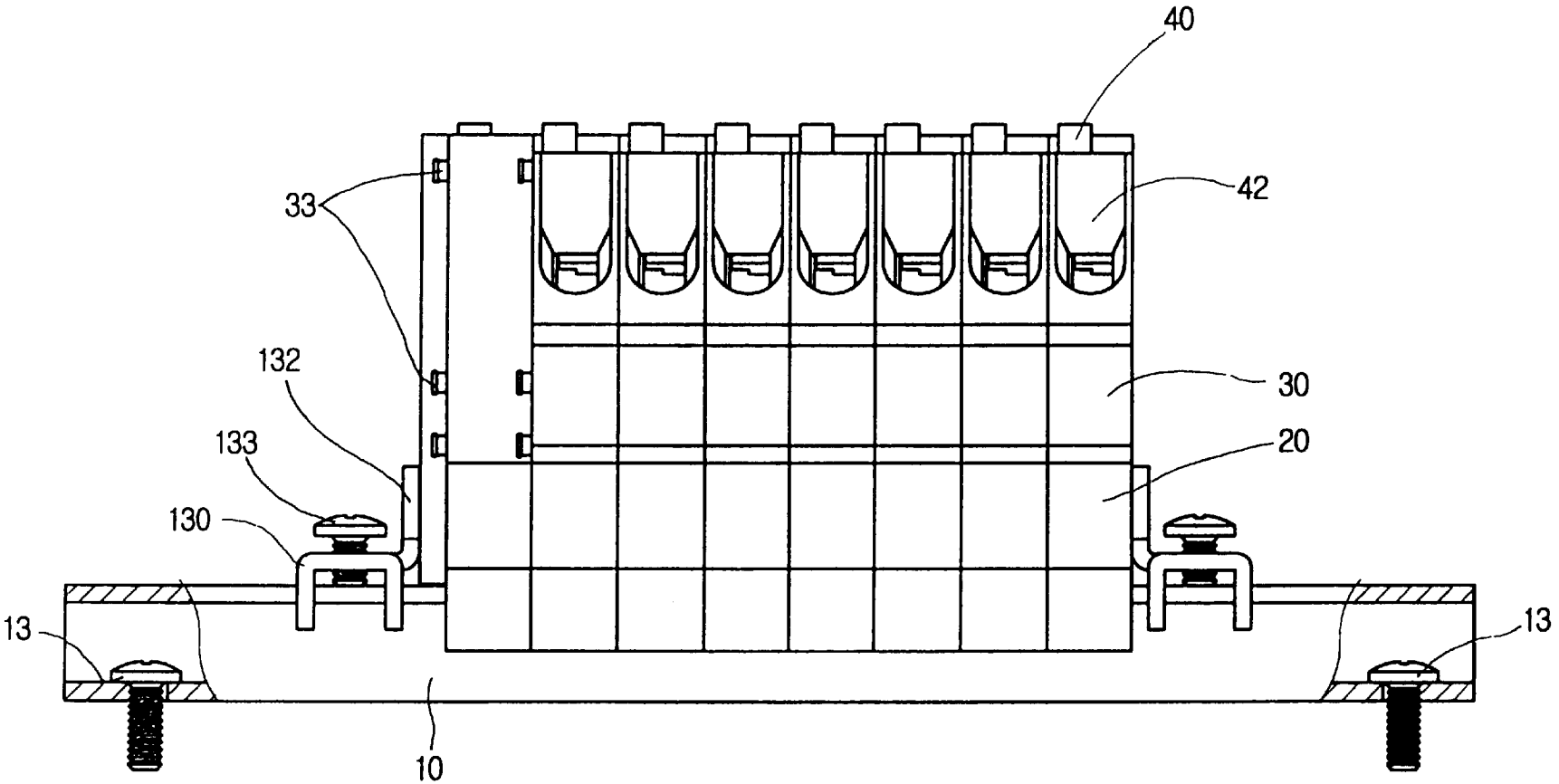
FIG. 5 is a side view showing an embodiment of the wire connecting device with exchangeable securing member for electric connection terminal assembly according to the present invention.

The wire connecting device 200 can be mounted on the angle iron 10 without any rolling by a mounting bracket 130 having an angle iron groove 131, which is engaged with the protruded fixing rim 11 of the angle iron 10, formed at the lower part thereof, and a supporting piece 132 formed elastically and in the form of the protrusion at the upper part thereof. Before fixing by the mounting bracket 130, a support plate 120 is inserted between the wire connecting device 200 and the mounting bracket 130 such that the protrusions 33 formed on the wire connecting device 200 are inserted into connecting grooves 34-1 formed on the support plate 120. Subsequently, the mounting bracket 130 is fixed to the angle iron 10 so that the wire connecting device 200 is prevented from rolling on the angle iron 10, as shown in FIG. 5.

A cap 90 having serial numbers 93 printed thereon is inserted into a cap groove 35 formed on the central upper part of the wire connecting device 200. A cap projection 92 provided on the lower part of the cap 90 is engaged with a projection 37 of the cap groove 35 formed on the inner wall of the cap groove 35, and a stop 36 is formed on the upper part of the projection 37 of the cap groove 35 so that the stop 36 fits into a connecting groove 94 formed on the edge of the cap 90. Therefore, the serial numbers 93 correspond to the positions of the connected wires 600.

The above descriptions relate to the wire connecting device 200 mounted on equipment using the angle iron 10. In some occasions, however, the wire connecting device 200 can be mounted directly on the board of the equipment without using the angle iron 10 as mentioned above. In this case, the securing member 20 is not used.

Figure 2:
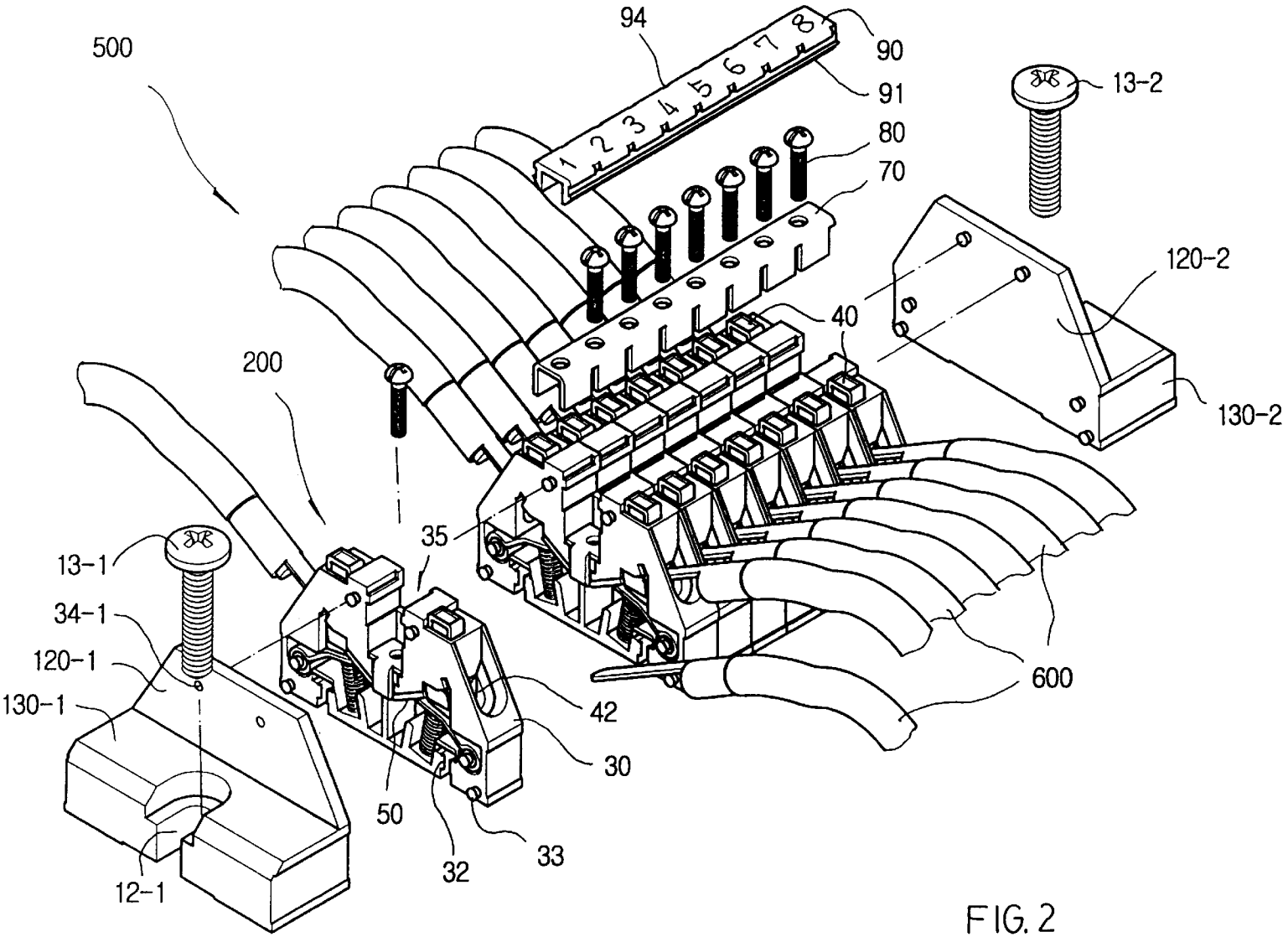
FIG. 2 is an exploded perspective view showing another embodiment of the wire connecting device with exchangeable securing member for electric connection terminal assembly according to the present invention.
Figure 3:
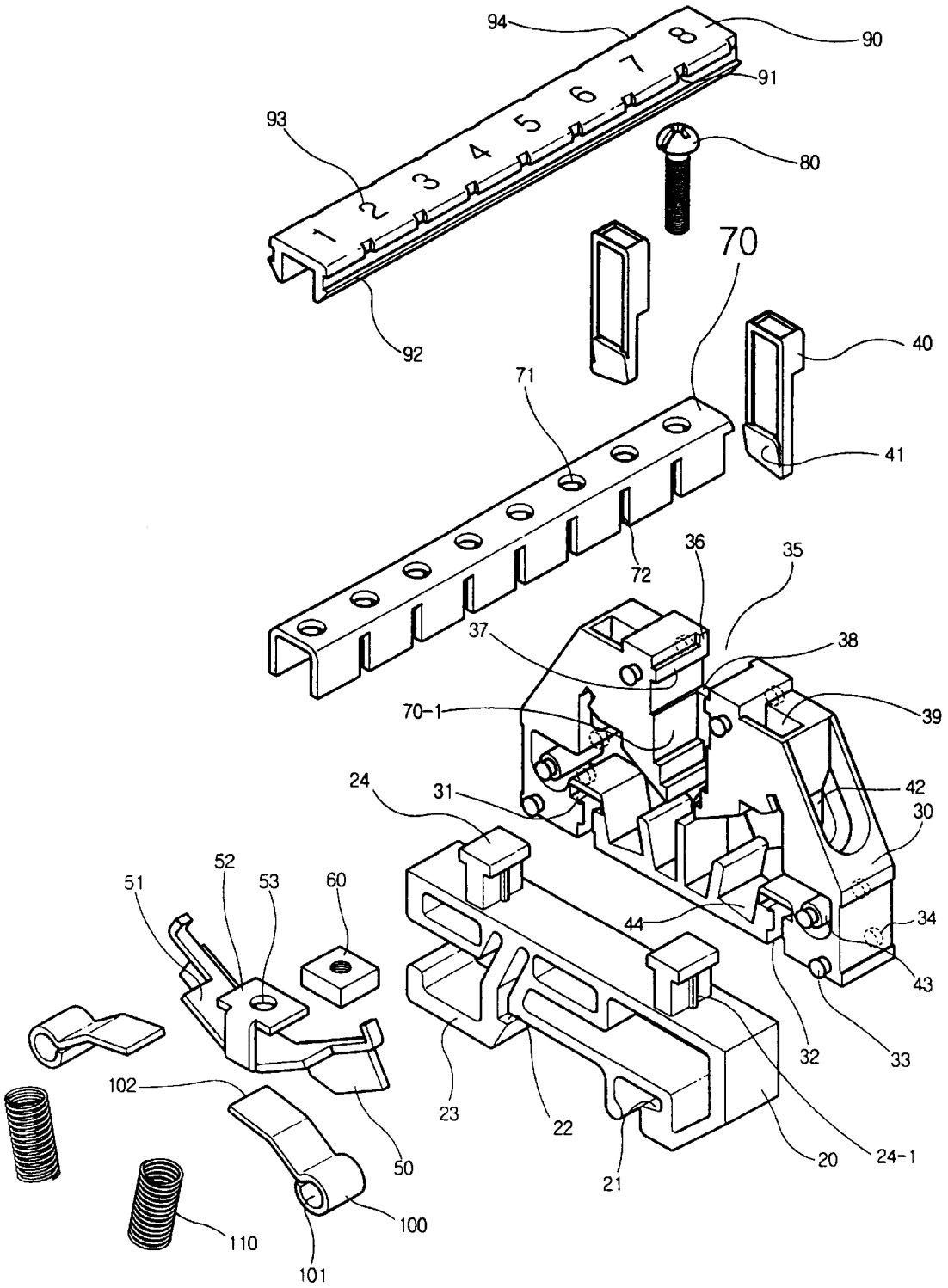
FIG. 3 is an exploded perspective view showing the wire connecting device of the present invention.
Figure 4:
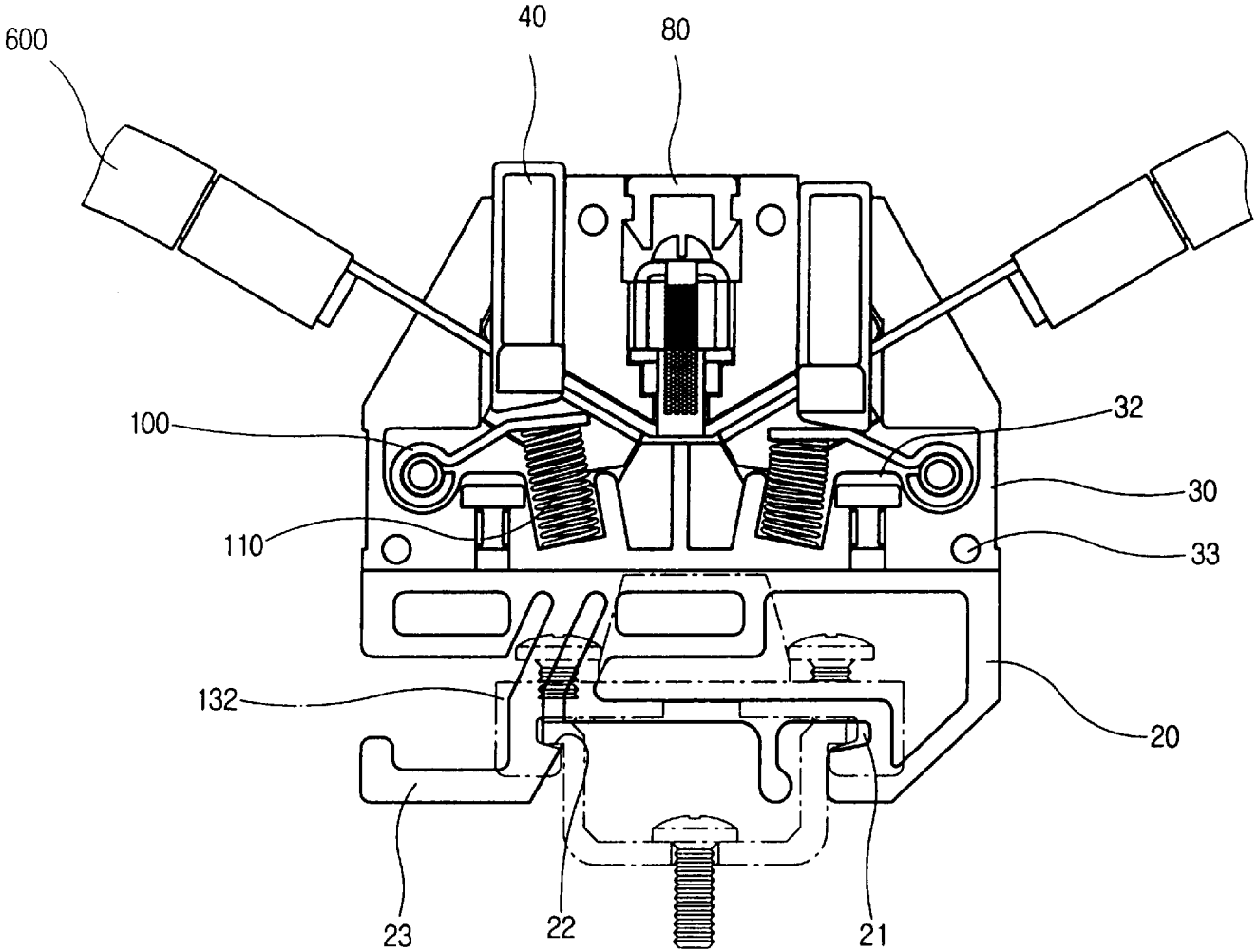
FIG. 4 is a front view showing the operation of the wire connecting device of the present invention.
Figure 6:
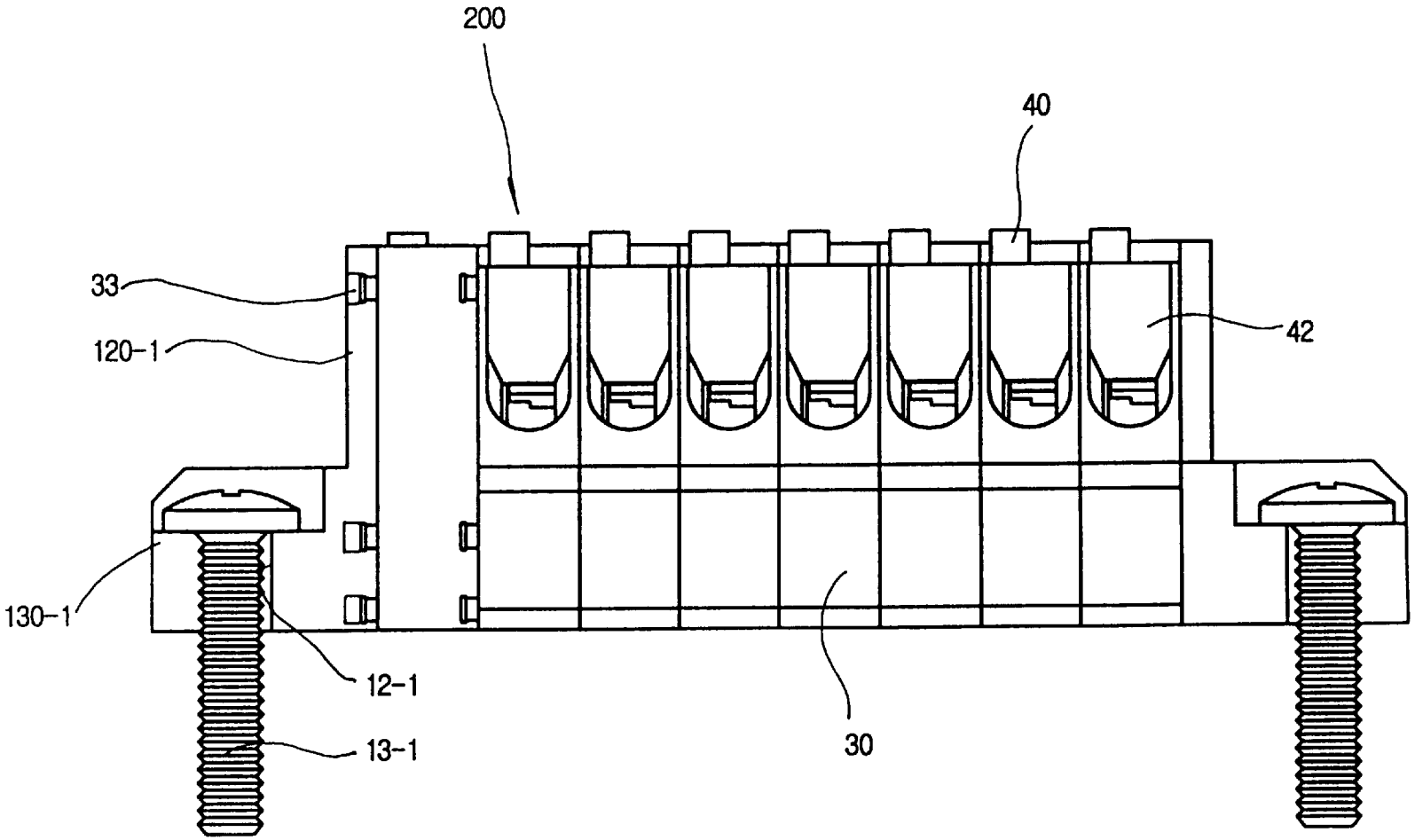
FIG. 6 is a side view showing another embodiment of the wire connecting device with exchangeable securing member for electric connection terminal assembly according to the present invention.

Another embodiment of the wire connecting device without the securing member is illustrated in FIG. 2 and FIG. 6. According to this embodiment, two mounting brackets 130-1 having a support plate 120-1 formed integrally are arranged at both ends of the wire connecting device 200. The wire connecting device 200 is mounted to the board of the equipment by screwing the mounting bolt 13-1 into the board via a mounting hole 12-1 formed at the one end of the mounting bracket 130-1.

In the wire connecting device 200 mounted as described above, however, the middle portions are not supported securely as compared with the wire connecting device 200 mounted securely to the angle iron 10, thus resulting in disconnection of the leading wire 600 from the wire connecting device 200, if the wire connecting device 200 is not provided with the connection member 70.

Figure 7:
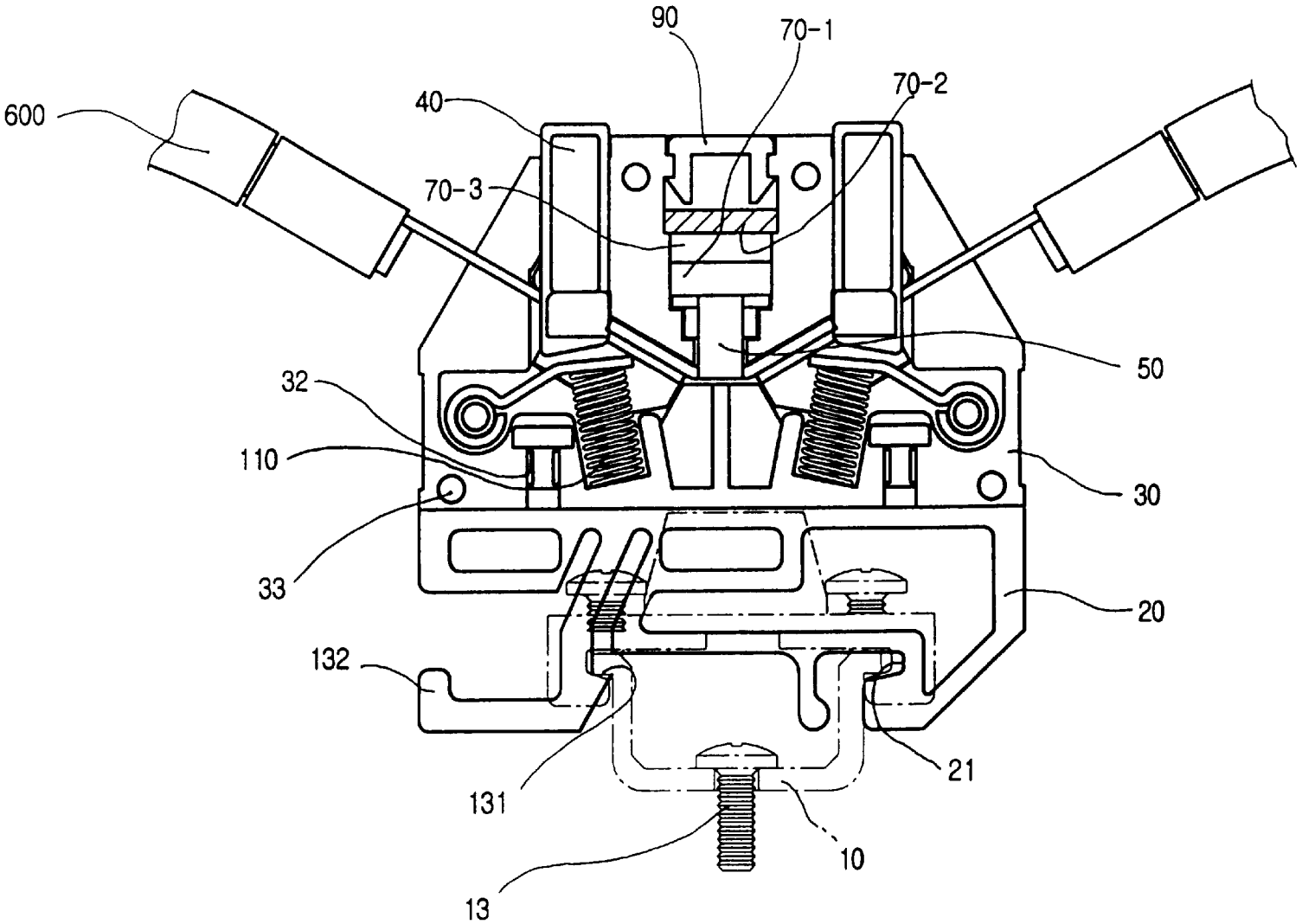
FIG. 7 is a front view showing another embodiment of the wire connecting device with exchangeable securing member for electric connection terminal assembly according to the present invention.

To avoid the disconnection as mentioned above, a connection member strip 70-2 corresponding to the connection 70 is inserted into the connecting groove 70-1 in which the connection member 70 was located. The connecting groove 70-1 is engaged with a connecting bar 70-3 formed integrally on the bottom of the connection strip 70-2, thus preventing the middle portion from getting loose, as illustrated in FIG. 7.

Now, the operation of the present invention will be described in detail.

First of all, mounting with the angle iron 20 will be described. Generally, the securing member 20 of the wire connecting device 200 mounted on the angle iron 10 may have various structures corresponding to various shapes and sizes of the angle irons 10 which several manufacturers use to mount on equipment. Previously, the connecting body and support member were integrally formed, thus raising manufacturing costs.

On the contrary, according to the present invention, various kinds of the securing members 20 can be made separately, and afterwards the securing member 20 is attached to the existing connecting body 30, thus the manufacturing costs can be reduced.

That is to say, the T-shaped protrusion 24 provided on the upper part of the securing member is inserted into the T-shaped groove 31 formed on the bottom of the connecting body 30 so that the securing member 20 is attached to the connecting body 30, an act which provides the same result as the connecting body 30 and the securing member 20 produced as a single body.

Figure 8:
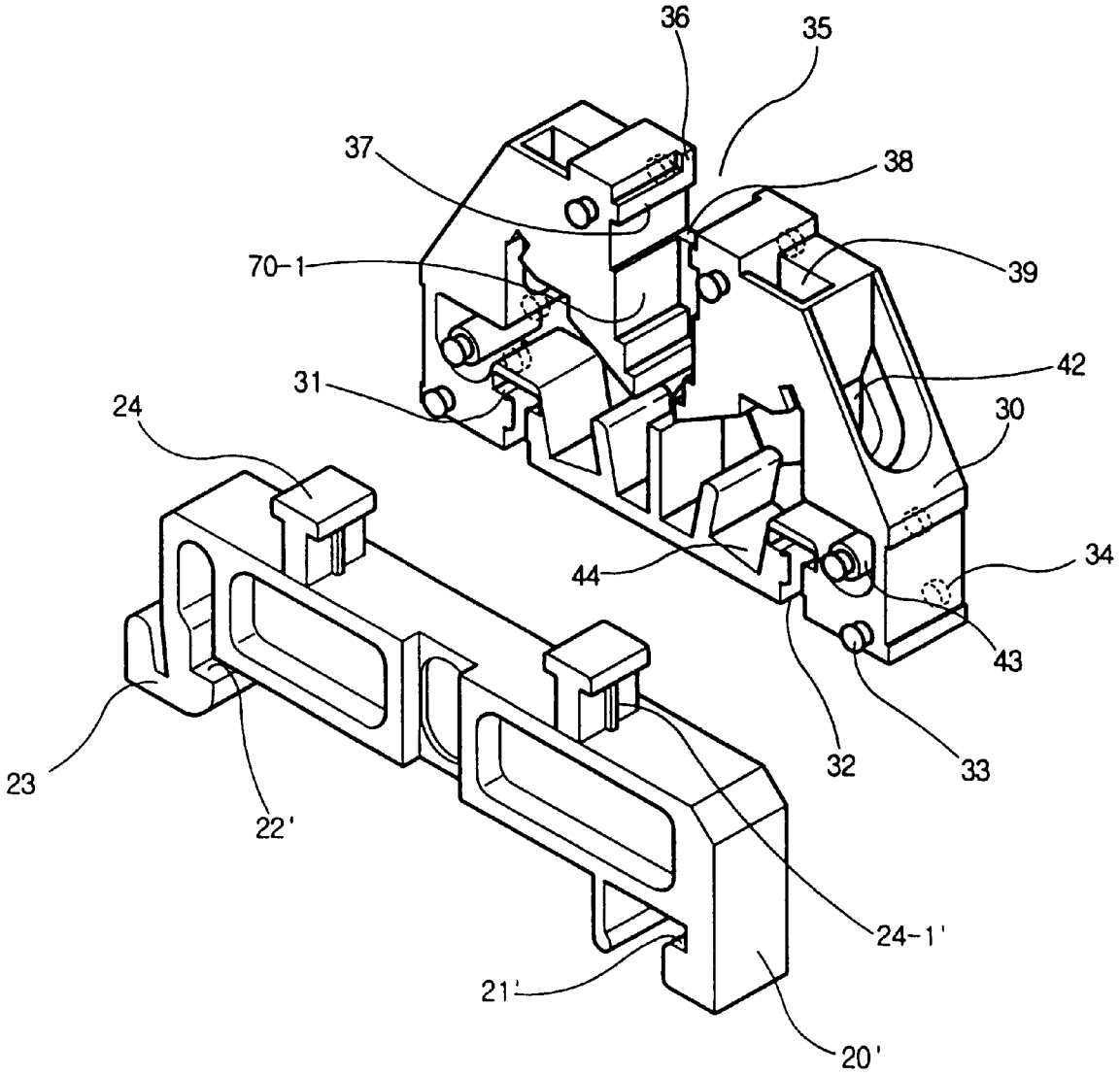
FIG. 8 is an exploded perspective view showing another embodiment of the exchangeable securing member according to the present invention.

The securing member 20, which is manufactured in different shapes and sizes, can be attached to the corresponding connecting body 30. Another example of the securing member is illustrated in FIG. 8. The securing member 20' as shown in FIG. 8 is similar to the securing member 20 as shown in FIG. 1 except for its size. Accordingly, the detailed descriptions thereof is omitted.

The wire connecting device 200 mounted on the angle iron 10 is applicable to large-scale equipment in which at least ten pieces of the wire connecting device are to be mounted, such as a telephone connection terminal box or electric control box supplying current to large-scale equipment.

Meanwhile, when the wire connecting device 200 is mounted to a small-scale piece of equipment or control box, the angle iron 10 is not necessarily required since the wire connecting devices 200 are small in number. In this case, the wire connecting device can be supported by engagement of protrusions 33 formed on the front surface of the connecting body 30 and grooves 34 formed on the rear surface of the wire connecting device 200. The wire connecting device 200 can further be fixed by the mounting bracket 130-1. Therefore, only the wire connecting device 200 can be used without the securing member 20.

As described above, the wire connecting device is obtained from the combination of the single type of connecting body and one securing member selected from various shapes and sizes of the securing members manufactured based upon the shapes and sizes of the angle irons to be used, the connecting body and the securing member being manufactured separately, thus the manufacturing costs can be reduced.

It is to be understood that the forms of the invention herewith shown and described are to be taken as illustrative embodiments of the same, and that various changes in the shape, size, and arrangement of parts, as well as various procedural changes, may be resorted to without departing from the spirit of the invention.

What is claimed is:

1. A connecting device comprising:

an electrically conductive connection base;

a first connection plate held by a first spring against a first portion of the connection base; and a second connection plate held by a second spring against a second portion, distal from the first portion, of the connection base;

wherein the connecting device is shaped to be mounted directly on a mounting surface by using support brackets placed on either side of the connecting device; and wherein the connecting device is farther shaped to be mounted on an angle iron by using a securing member, wherein the securing member is coupled between the connecting device and the angle iron.

2. The connecting device of claim 1 further comprising a first protrusion on a front side of the connecting device and a first groove on a reverse side of the connecting device, wherein the first protrusion and the first groove are each shaped to mate with a second groove or a second protrusion, respectively, on a similarly shaped second connecting device.

3. The connecting device of claim 2 further comprising a support plate shaped to receive the protrusion.

4. The connecting device of claim 1 further comprising an electrically conductive connection member, wherein the connection member is positioned to make electrical contact between a third portion of the connection base and a second connection base in an adjacent similarly configured second connecting device.

5. The connecting device of claim 4 further comprising a cap fitted into the connection device over the connection member.

6. The connecting device of claim 5 wherein the cap includes a serial number identifying the connecting device.

7. The connecting device of claim 1 further comprising a connection strip, wherein the connection strip is positioned to provide structural support between the connecting device and a second similarly configured connecting device.

8. The connecting device of claim 1, wherein the connecting device includes a groove and the securing member includes a protrusion shaped to fit within the groove.

9. The connecting device of claim 8, wherein the groove and the protrusion are T-shaped.

10. The connecting device of claim 1, wherein the securing member includes a release lever shaped to receive a portion of the angle iron.

11. The connecting device of claim 1 further comprising a button positioned against the first connection plate, wherein movement of the button moves the connection plate away from the connection base.

12. A method of connecting at least two wires comprising:

providing a connecting device;

wherein the connecting device includes an electrically conductive connection base, a first connection plate held by a first spring against a first portion of the connection base, and a second connection plate held by a second spring against a second portion, distal from the first portion, of the connection base;

wherein the connecting device is shaped to be mounted directly on a mounting surface using support brackets placed on either side of the connecting device; and wherein the connecting device is further shaped to be mounted on an angle iron using a securing member, and wherein the securing member is configured to be coupled to the connecting device and to the angle iron;

inserting a first wire between the first connection plate and the connection base; and inserting a second wire between the second connection plate and the connection base.

13. The method of claim 12 further comprising mounting the connecting device to a mounting surface without the use of an angle iron.

14. The method of claim 12 further comprising coupling the connecting device to the securing member and coupling the securing member to the angle iron.

15. The method of claim 12 further comprising using an electrically conductive coupling member to electrically couple the connection base to a second connection base in a second similarly configured connecting device.

16. The method of claim 12 further comprising using a connection strip to provide structural support between the connecting device and a second similarly configured connecting device.

17. A connecting device comprising:

an electrically conductive connection base;

means for electrically connecting a first wire to a first portion of the connection base;

means for electrically coupling a second wire to a second portion of the connection base;

means for mounting the connecting device directly to a mounting surface; and means for coupling the connecting device to a securing member, wherein the securing member includes means for coupling the securing member to an angle iron.

18. The connecting device of claim 17 further comprising means for electrically coupling the connection base to a second connection base in a second similarly configured connecting device.

19. The connecting device of claim 17 further comprising means for providing structural support between the connecting device and a second similarly configured connecting device.

20. The connecting device of claim 17 further comprising a protrusion and a groove, wherein the protrusion and the groove are positioned to mate with adjacent similarly configured second connecting devices.

21. The connecting device of claim 17, wherein the means for mounting the connection device directly to a mounting surface includes a support bracket.

* * * * *